United States Patent [19]

Ozawa

[11] 4,352,549

[45] Oct. 5, 1982

[54] ELECTROPHOTOGRAPHIC COPYING METHOD AND APPARATUS

[75] Inventor: Takashi Ozawa, Ebina, Japan

[73] Assignee: Rank Xerox Limited, London, England

[21] Appl. No.: 164,996

[22] Filed: Jul. 1, 1980

[30] Foreign Application Priority Data

Jul. 27, 1979 [JP] Japan ..... 54-094915

[51] Int. Cl.[3] ..... G03G 15/00

[52] U.S. Cl. ..... 355/3 R; 355/11

[58] Field of Search ..... 355/3 R, 11, 50, 51, 355/64, 65

[56] References Cited

U.S. PATENT DOCUMENTS

| | | | |
|---|---|---|---|
| 2,357,809 | 9/1944 | Carlson . | |
| 2,576,047 | 11/1951 | Schaffert . | |
| 3,043,217 | 7/1962 | Walkup . | |
| 3,973,846 | 8/1976 | Sullivan et al. | 355/3 R X |
| 4,003,651 | 1/1977 | Hashida et al. | 355/3 R X |
| 4,167,324 | 9/1979 | Wu | 355/3 R |
| 4,167,326 | 9/1979 | Payne | 355/64 X |

FOREIGN PATENT DOCUMENTS

| | | | |
|---|---|---|---|
| 52-66440 | 6/1977 | Japan | 355/3 R |
| 55-96971 | 7/1980 | Japan | 355/3 R |

*Primary Examiner*—G. Z. Rubinson
*Assistant Examiner*—Keith E. George

[57] ABSTRACT

An electrophotographic copying method and apparatus in which a powder image of an original document is transferred from the photoconductor to a receiving member. Thereafter, an electrostatic latent image of this transferred powder image is formed back onto the same photoconductor. The latent image is then developed and transferred to a copy sheet and fixed to produce a finished print. In a preferred embodiment, the transferred powder image is repeatedly utilized to form successive electrostatic latent images on the photoconductor. These electrostatic latent images are then developed to produce powder images which are subsequently transferred and fused to copy sheets forming a multiplicity of copies from the same original document.

12 Claims, 2 Drawing Figures

ELECTROPHOTOGRAPHIC COPYING METHOD AND APPARATUS

Figure 1:
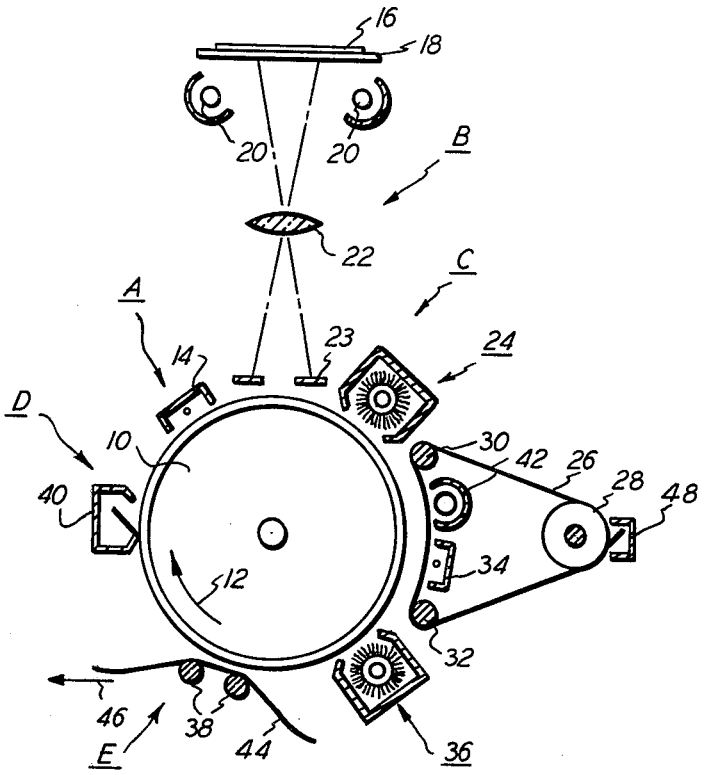

This invention relates generally to an electrophotographic printing machine, and more particularly concerns a printing machine in which multiple copies are formed from a common original document.

Generally, the process of electrophotographic printing includes charging of a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix it to the copy sheet in image configuration.

In this method of electrophotographic printing, various inconveniences are encountered. When a large number of copies are being reproduced from a common original document, it is necessary to irradiate and scan the original document each time for successive copies. Since the electrical energy required for irradiation and scanning is relatively large, the power consumption is unavoidably increased. Furthermore, the drive mechanism of the optical scanning system must be capable of operating at high speeds in order to produce a large number of copies in a relatively short time. This leads to a reduction in the durability of the scanning system. In other machines, wherein the optical system remains stationary while the original document moves with respect thereto, copy speed and large consumptions of power are required. In order to overcome the foregoing disadvantages, masters have frequently been formed from which successive copies are reproduced.

Various techniques have been developed for producing multiple copies from a single master. The following disclosures appear to be relevant:

U.S. Pat. No. 2,357,809
Patentee: Carlson
Issued: Sept. 12, 1944

U.S. Pat. No. 2,576,047
Patentee: Schaffert
Issued: Nov. 20, 1951

U.S. Pat. No. 3,043,217
Patentee: Walkup
Issued: July 10, 1962

The relevant portions of the foregoing disclosures may be briefly summarized as follows:

Carlson describes a method of preparing a master plate on which an electrostatic latent image is developed. In one embodiment, the resin powder is transferred to a lithographic sheet. The resin is melted onto the lithographic sheet to produce a master suitable for offset press operations. In another method, the resin powder is melted onto the photoconductive member to form a master plate.

Schaffert and Walkup disclose a method of printing multiple copies. A printing plate having an electrically insulating or nonconductive image thereon is charged. Developer powder adheres thereto so as to form a powder image. The powder image is then transferred to a paper strip. Heat is applied to the paper strip permanently fusing the powder image thereto. Residual powder is then cleaned from the plate preparatory for the start of the next successive cycle.

In accordance with the features of the present invention, there is provided an electrophotographic printing machine of the type in which a powder image of an original document is formed on a photoconductive member. A receiving member is positioned closely adjacent to the photoconductive member. Means transfer the powder image from the photoconductive member to the receiving member. Means are provided for recording an electrostatic latent image on the photoconductive member transferred to the receiving member on the photoconductive member.

Figure 2:
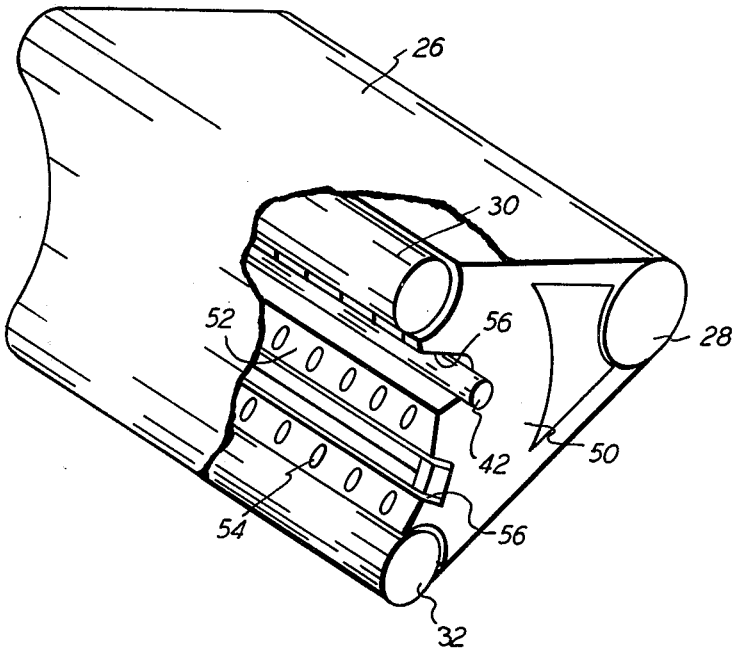

Other aspects of the present invention will become apparent as the following description proceeds and upon reference to the drawing, in which:

FIG. 1 is a schematic elevational view illustrating an electrophotograhic printing machine incorporating the features of the present invention therein; and FIG. 2 is a schematic prospective view showing the belt assembly arranged to receive a powder image from the photoconductive member.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the features of the present invention therein. It will become apparent from the following discussion that the high speed copying aspect of the present invention are equally well suited for use in a wide variety of electrophotographic printing machines and are not necessarily limited in their application to the particular embodiment shown herein.

Inasmuch as the art of electrophotographic printing is well known, the various processing stations employed in the FIG. 1 printing machine will be shown hereinafter schematically and their operation described briefly with reference thereto.

Referring now to FIG. 1, the electrophotographic printing machine employs a drum 10 having a photoconductive surface deposited on a conductive substrate. Preferably, the photoconductive surface is made from selenium with the conductive substrate being made preferably from aluminum. Drum 10 moves in the direction of arrow 12 to advance successive portions of the photoconductive surface sequentially through the various processing stations disposed about the path of movement thereof.

Initially, a portion of drum 10 passes through charging station A. At charging station A, a corona generating device, indicated generally by the reference numeral 14, charges the photoconductive surface to a relatively high, substantially uniform potential.

After the photoconductive surface of drum 10 is charged, the charged portion thereof is advanced through exposure station B. At exposure station B, an original document 16 is positioned face-down upon a transparent platen 18. Lamps 20 and lens 22 move across the original document illuminating successive incremental widths thereof. The light rays reflected from original document 16 are transmitted through lens 22 forming a light image thereof. Lens 22 focuses the light image onto the charged portion of the photoconductive surface through slit 23 to selectively dissipate the charge thereon. This records an electrostatic latent image on the photoconductive surface which corresponds to the informational areas contained within the original document 16.

After the electrostatic latent image has been recorded on the photoconductive surface, drum 10 advances the latent image to the first development station C. At development station C, a magnetic brush development system, indicated generally by the references numeral 24, advances developer material into contact with the latent image. Preferably, magnetic brush development system 22 includes a magnetic brush developer roller. The roller advances developer material into contact with the latent image. The developer roller forms a brush extending outwardly therefrom of carrier granules and toner particles. The latent image attracts toner particles from the carrier granules forming a toner powder image on the latent image.

Next, the powder image on drum 10 is advanced to the receiving member which is a belt 26 made of a transparent dielectric material. Belt 26 is entrained about rollers 28, 30, and 32. Belt 26 is positioned in contact with the photoconductive surface of drum 10. Roller 28 is coupled to a motor and moves belt 26 at the same speed as drum 10. A corona generating device 34 disposed on the opposite side of belt 26 from drum 10 is energized to transfer the powder image from the photoconductive surface of drum 10 to belt 26. In this way, a toner powder image is formed on belt 26. At this time, the second development station, indicated generally by the references numeral 36, and the sheet feeding apparatus, (not shown) are inoperative. After all of the powder image on the photoconductive surface of drum 10 has been transferred to belt 26, belt 26 is spaced from the photoconductive surface of drum 10. This produces a specified gap between belt 26 and the photoconductive surface of drum 10. As drum 10 continues to rotate in the direction of arrow 12, it passes through cleaning station D. At cleaning station D, a cleaning blade 40 removes any residual particles adhering to drum 10. Thereafter, exposure station B and development system 24 are placed in the inoperative condition. Now, corona generating device 14 charges the photoconductive surface of drum 10 to a substantially uniform potential. Light source 42 disposed on the side of belt 26 opposed from drum 10 is energized. The powder image on belt 26 is irradiated and an image projected through belt 26 onto the charged portion of the photoconductive surface of drum 10. Thus, by energizing light source 42 and moving drum 10 and belt 26 at equal speeds, an electrostatic latent image of the powder image is formed on the photoconductive surface of drum 10. The second electrostatic latent image is developed by energizing development system 36. Development system 36 is substantially identical to development system 24. Energization of development system 36 forms a powder image on the photoconductive surface of drum 10 corresponding to the powder image on dielectric belt 26.

After the second electrostatic latent image is developed, drum 10 advances the toner powder image to transfer station E. At station E, a sheet of support material 44 is moved into contact with the toner powder image thereat. The sheet of support material is advanced to transfer station E by a sheet feeding apparatus. Preferably, the sheet feeding apparatus includes a feed roll contacting the uppermost sheet of the stack of sheets. The feed roll rotates to advance the uppermost sheet from the stack into a chute. The chute directs the advancing sheet of support material between rollers 38 and drum 10. Rollers 38 press sheet 44 into contact with the photoconductive surface of drum 10 in a timed sequence so that the toner powder image developed thereon contacts sheet 44 at transfer station E. At transfer station E, a corona generating device sprays ions onto the backside of sheet 44. This attracts the toner powder image from the photoconductive surface to sheet 44. After transfer, sheet 44 continues to move in the direction of arrow 46 onto a conveyor which advances sheet 44 to a fusing station.

At the fusing station (not shown), sheet 44 with the powder image thereon, passes between a back-up roller and a fuser roller. The powder image contacts the fuser roller and the heat and pressure applied thereto permanently affixes it to sheet 44. After fusing, forwarding rollers advance the finished copy sheet to a catch. Once the copy sheet is positioned in the catch tray, it may be readily removed therefrom by the machine operator.

In the situation where a large number of copies are reproduced from the same original document, successive electrostatic latent images are formed on the photoconductive surface of drum 10 from the powder image on dielectric belt 26. After the required number of copies have been obtained, the powder image on dielectric belt 26 is removed therefrom by a cleaning system, indicated generally by the reference numeral 48. Cleaning system 48 includes a blade arranged to be moved into contact with belt 26 to scrape off any particles adhering thereto.

Since the powder image on transparent dielectric belt 26 adheres thereto by electrostatic forces, there is a possibility that the image may scatter with the passage of time and the movement of belt 26. However, this disturbance and scattering of the image may be minimized by making rollers 28, 30 and 32 from a high electrical resistance material, or by operating corona generating device 34 so as to increase the adhesive force of the powder image to belt 26.

Referring now to FIG. 2, there is shown the mounting structure for transparent dielectric belt 26. As depicted thereat, drive roller 28 and guide rollers 30 and 32 are rotatably mounted on the vertices of hollow, triangular housing 50. Transparent dielectric belt 26 is entrained around each of the rollers 28, 30 and 32 so that belt 26 moves along the peripheral wall of housing 50. At the same time, end wall 52 at the side adjacent the photoconductive surface of drum 10 of housing 50 is constructed in an arcuate shape having the same curvature as that of drum 10. A plurality of apertures or holes 54 are provided in end wall 52. Dielectric belt 26 is closely attracted to the photoconductive surface of drum 10. Dielectric belt 26 is attracted to wall 52 by a vacuum produced from the interior of housing 50. Belt 26 moves along end wall 52. Recessed grooves 56 are formed in end wall 52 for mounting light source 42 and corona generating device 34. Housing 52 is arranged to be moved as an entire assembly so as to provide the required spacing between belt 26 and the photoconductive surface of drum 10. The movement of housing 50 provides ready access thereto.

While housing 50 has been shown as a triangular configuration, one skilled in the art can readily appreciate that many other shapes may also be suitable.

In the electrophotographic printing machine of the present invention, the original document is irradiated only one time. Thus, the exposure system is activated only once. This improves the durability of the scanning system when a large number of copies are required from the same original document. In addition, energy consumption is reduced. A large number of copies are formed from the same original document by producing a powder image on a transparent dielectric belt. The belt is then illuminated to form successive electrostatic latent images corresponding to the powder image on the photoconductive member. These electrostatic latent images are then developed to produce powder images which are subsequently transferred to the copy sheet. The powder images are then fused to the copy sheet forming a multiplicity of copies from the same original document. It is thus clear, that when the operator presses the print button and dials more than one copy, after the first electrostatic latent image is formed, the exposure system and the first development system are de-energized while the system for exposing the toner powder image on the dielectric belt and the second development system are energized. Furthermore, the system for transferring the powder image to the copy sheet is only energized after the second electrostatic latent image is developed. Alternatively, if only one copy is being reproduced, the second development system remains inactivated as does the transfer system for transferring the powder image to the dielectric belt. This results in the powder image being transferred directly to the copy sheet rather than to the dielectric belt. Hence, the electrophotographic printing machine operates in a dual mode. One mode optimizes reproduction of single copies whereas the second mode optimizes reproduction of multiple copies from the same original document.

It is, therefore, apparent that there has been provided, in accordance with the present invention, an electrophotographic printing machine that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. In an electrophotographic printing machine of the type in which a powder image of an original document is formed on a photoconductive member, a latent image forming device comprising:

a receiving member positioned closely adjacent the photoconductive member;

means for transferring the powder image from the photoconductive member to said receiving member; and means for recording on the photoconductive member an electrostatic latent image of the powder image transferred to said receiving member.

2. An electrophotographic printing machine comprising:

means for forming a powder image of an original document on a photoconductive member;

a receiving member positioned closely adjacent the photoconductive member;

means for transferring the powder image from the photoconductive member to said receiving member;

means for recording on the photoconductive member an electrostatic latent image of the powder image transferred to said receiving member;

means for developing the electrostatic image to form a second powder image on the photoconductive member after transferring the first mentioned powder image to said receiving member;

second means, spaced from said first mentioned transferring means, for transferring the second powder image to a copy sheet; and means for permanently fixing the second powder image to the copy sheet.

3. A printing machine according to claim 2, further including operator actuatable means for energizing said forming means, said developing means, said transferring means and said fixing means a selected number of times to produce a plurality of copies of the same original document.

4. A printing machine according to claim 3, further including means for removing the first mentioned powder image from said receiving member prior to forming a copy of another original document.

5. A printing machine according to claims 2, 3 or 4, further including:

means for charging the photoconductive member;

means for exposing the charged photoconductive member to a light image of the original document to record the electrostatic latent image of the original document thereon; and second means, spaced from said first mentioned developing means, for developing the electrostatic latent image of the original document to form the powder image thereof on the photoconductive member.

6. A printing machine according to claim 5, wherein:

said receiving means includes a light permeable belt;

said first mentioned transferring means includes a corona generating device positioned on the side of said belt opposed from the photoconductive member so as to transfer the powder image from the photoconductive member to the side of said belt adjacent the photoconductive member; and said receiving means includes a light source positioned on the side of said opposed from the photoconductive member so as to transmit light rays through said belt onto the charge photoconductive member selectively discharging the charge to record the electrostatic image of the powder image transferred to said belt thereon.

7. A printing machine according to claim 6, wherein said second transferring means includes a corona generating device positioned adjacent the photoconductive member with the copy sheet passing therebetween so as to spray ions onto the backside of the copy sheet to transfer the second powder image to the copy sheet.

8. In electrophotographic printing, a method of forming an electrostatic latent image comprising the steps of:

forming a powder image of an original document on a photoconductive member;

transferring the powder image from the photoconductive member to a light permeable belt; and recording on the photoconductive member an electrostatic latent image of the powder image transferred to the belt.

9. A method of electrophotographic printing, comprising the steps of:

forming a powder image of an original document on a photoconductive member;

transferring the powder image from the photoconductive member to a light permeable belt;

recording on the photoconductive member an electrostatic latent image of the powder image transferred to the belt;

developing the electrostatic latent image to form a second powder image on the photoconductive member after said step of transferring the first mentioned powder image to the belt;

transferring the second powder image from the photoconductive member to a copy sheet; and fixing substantially permanently the second powder image to the copy sheet.

10. A method of printing according to claim 9, further including the step of energizing said steps of recording, developing, transferring and fixing a selected number of times to produce a plurality of copies of the same original document.

11. A method of printing according to claim 10, further including the step of removing the first mentioned powder image from the receiving member prior to forming a copy of another original document.

12. A method of printing according to claims 9, 10 or 11, wherein said step of forming includes the steps of:

charging the photoconductive member;

exposing the charged photoconductive member to a light image of the original document to record an electrostatic latent image of the original document on the photoconductive member; and developing the electrostatic latent image of the original document to form the powder image thereof on the photoconductive member.

* * * * *

UNITED STATES PATENT AND TRADEMARK OFFICE

CERTIFICATE OF CORRECTION

PATENT NO. : 4,352,549

DATED : October 5, 1982

INVENTOR(S) : Takashi Ozawa

It is certified that error appears in the above-identified patent and that said Letters Patent are hereby corrected as shown below:

Claim 6, line 48, change "means" to - -member- - ;

line 55, change "receiving" to - -recording— ;

line 56, after the word "said", add the word - -belt- - ; and line 60, after the word "electrostatic", add the word - -latent- - .

Signed and Sealed this

*Twenty-second* Day of *February 1983*

[SEAL]

*Attest:*

GERALD J. MOSSINGHOFF

*Attesting Officer*

*Commissioner of Patents and Trademarks*